US009523945B2

(12) United States Patent
Nakajima et al.

(10) Patent No.: US 9,523,945 B2
(45) Date of Patent: Dec. 20, 2016

(54) IMAGE FORMING APPARATUS THAT FORMS IMAGE ON IMAGE CARRIER

(71) Applicant: CANON KABUSHIKI KAISHA, Tokyo (JP)

(72) Inventors: Hirohisa Nakajima, Tsukubamirai (JP); Takayuki Iikura, Kashiwa (JP); Shuji Obata, Noda (JP); Mitsuhiro Sugeta, Abiko (JP); Kazunori Miyake, Abiko (JP); Toshifumi Kakutani, Abiko (JP); Yousuke Hata, Ichikawa (JP); Shinya Suzuki, Toride (JP); Manabu Koseki, Sakuragawa (JP); Takeyuki Suda, Nagareyama (JP); Toshiyuki Abe, Toride (JP); Kazumi Sato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/991,355

(22) Filed: Jan. 8, 2016

(65) Prior Publication Data

US 2016/0202643 A1 Jul. 14, 2016

(30) Foreign Application Priority Data

Jan. 13, 2015 (JP) ..... 2015-004514

(51) Int. Cl.
*G03G 15/00* (2006.01)
*G03G 15/16* (2006.01)

(52) U.S. Cl.
CPC ..... *G03G 15/1665* (2013.01); *G03G 15/55* (2013.01); *G03G 15/80* (2013.01)

(58) Field of Classification Search
CPC ..... G03G 15/80; G03G 15/55
USPC ..... 399/9
See application file for complete search history.

(56) References Cited

U.S. PATENT DOCUMENTS

2009/0161178 A1* 6/2009 Sugeta ..... H04N 1/191 358/475
2013/0141751 A1* 6/2013 Hata ..... G06F 3/12 358/1.14

FOREIGN PATENT DOCUMENTS

JP 2002-178490 A 6/2002
JP 2002-333812 A 11/2002

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

An image forming unit forms a toner image on an image carrier, and transfers the toner image to a recording medium. A voltage generation circuit generates a high voltage used for the image forming unit. A control circuit is connected to the voltage generation circuit via a cable, and controls the high voltage generated by the voltage generation circuit. A detection unit detects a current flowing in a load of the image forming unit to which the high voltage generated by the voltage generation circuit is applied. A determination unit determines an error in accordance with a current range in which the current detected by the detection unit falls. The current range is included among a plurality of current ranges that are in one-to-one correspondence with a plurality of errors.

15 Claims, 10 Drawing Sheets

IMAGE FORMING APPARATUS THAT FORMS IMAGE ON IMAGE CARRIER

BACKGROUND OF THE INVENTION

Field of the Invention

The present invention relates to an image forming apparatus including a high-voltage generation circuit.

Description of the Related Art

In an image forming apparatus of an electrophotographic type, a voltage (high voltage) that is higher than a voltage of a commercial power supply is applied to charging rollers, developing rollers, and transfer rollers. A high voltage generated by a high-voltage generation circuit may be used for purposes other than image formation. Japanese Patent Laid-Open No. 2002-333812 suggests a method of detecting abnormal attachment of photosensitive drums in accordance with a current that flows in charging rollers as a result of applying a high voltage to the charging rollers.

Incidentally, in an image forming apparatus, a control board on which a control circuit is mounted and a high-voltage board on which a high-voltage generation circuit is mounted are electrically connected via a cable. It is thus necessary to detect the state of electric connection between the control board and the high-voltage board. Japanese Patent Laid-Open No. 2002-178490 suggests the following technique: connectors for boards include a plurality of terminals that are lined up thereinside, two terminals located at both ends in each connector are short-circuited when mounting the boards, and a connection detection circuit judges that a normal state has been achieved when the short-circuited state is detected via a cable connected to the connectors.

However, according to Japanese Patent Laid-Open No. 2002-178490, it is necessary to provide the connection detection circuit on at least one of the two boards that are connected via the cable. Furthermore, among a plurality of signal lines constituting the cable, two signal lines located at both ends are used only for the connection detection, and cannot be used for other purposes. Similarly, the two terminals inside each connector cannot be used for other purposes. Such restrictions are disadvantageous in terms of installation space and manufacturing cost.

SUMMARY OF THE INVENTION

In view of the above, the present invention provides a connection detection method that is advantageous in terms of space on boards and manufacturing cost.

The present invention provides an image forming apparatus comprising the following elements. An image forming unit forms a toner image on an image carrier, and transfers the toner image to a recording medium. A voltage generation circuit generates a high voltage used for the image forming unit. A control circuit is connected to the voltage generation circuit via a cable, and controls the high voltage generated by the voltage generation circuit. A detection unit detects a current flowing in a load of the image forming unit to which the high voltage generated by the voltage generation circuit is applied. A determination unit determines an error in accordance with a current range in which the current detected by the detection unit falls. The current range is included among a plurality of current ranges that are in one-to-one correspondence with a plurality of errors.

Further features of the present invention will become apparent from the following description of exemplary embodiments (with reference to the attached drawings).

DESCRIPTION OF THE EMBODIMENTS

First Embodiment

Figure 1:
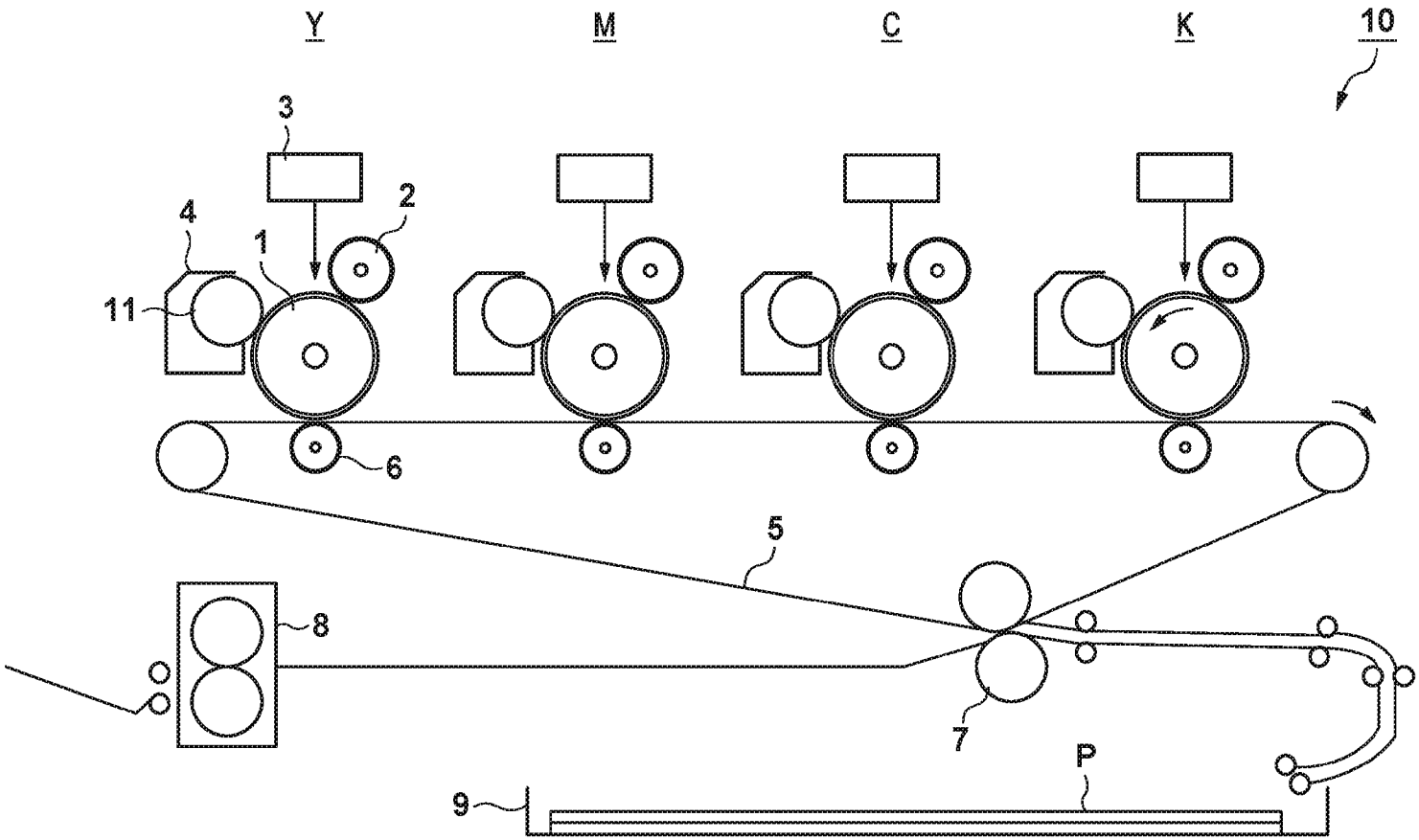
FIG. 1 illustrates a configuration of an image forming apparatus.

With reference to FIG. 1, the following describes an image forming apparatus 10 of an electrophotographic type. As is well known, the image forming apparatus 10 electrophotographically forms an image on a sheet of recording material P. Note that Y, M, C, and K denote yellow, magenta, cyan, and black, that is to say, colors of toner. Four image forming stations are provided as four colors of toner are used. As the stations are configured in the same way, only the station corresponding to yellow is given reference signs.

A charging roller 2 uniformly charges a surface of a photosensitive drum 1. A charging voltage is applied to the charging roller 2. A laser scanner 3 is an exposure apparatus that forms an electrostatic latent image by irradiating and scanning the uniformly-charged surface of the photosensitive drum 1 with light corresponding to an image signal. A developer 4 includes a development sleeve 11, and develops the electrostatic latent image formed on the photosensitive drum 1 as toner is released toward the electrostatic latent image, thereby forming a toner image. A developing voltage for advancing the development is applied to the development sleeve 11. A primary transfer roller 6 transfers the toner image on the photosensitive drum 1 to an intermediate transfer belt 5. A primary transfer voltage for advancing the primary transfer is applied to the primary transfer roller 6. A secondary transfer roller 7 performs secondary transfer, or more specifically, transfers the toner image that has been transferred to the intermediate transfer belt 5 to the sheet of recording material P fed from a sheet feeding cassette 9. A secondary transfer voltage for performing the secondary transfer is applied to the secondary transfer roller 7. A fixing device 8 fixes the toner image to the sheet of recording material P by application of heat and pressure.

Figure 2:
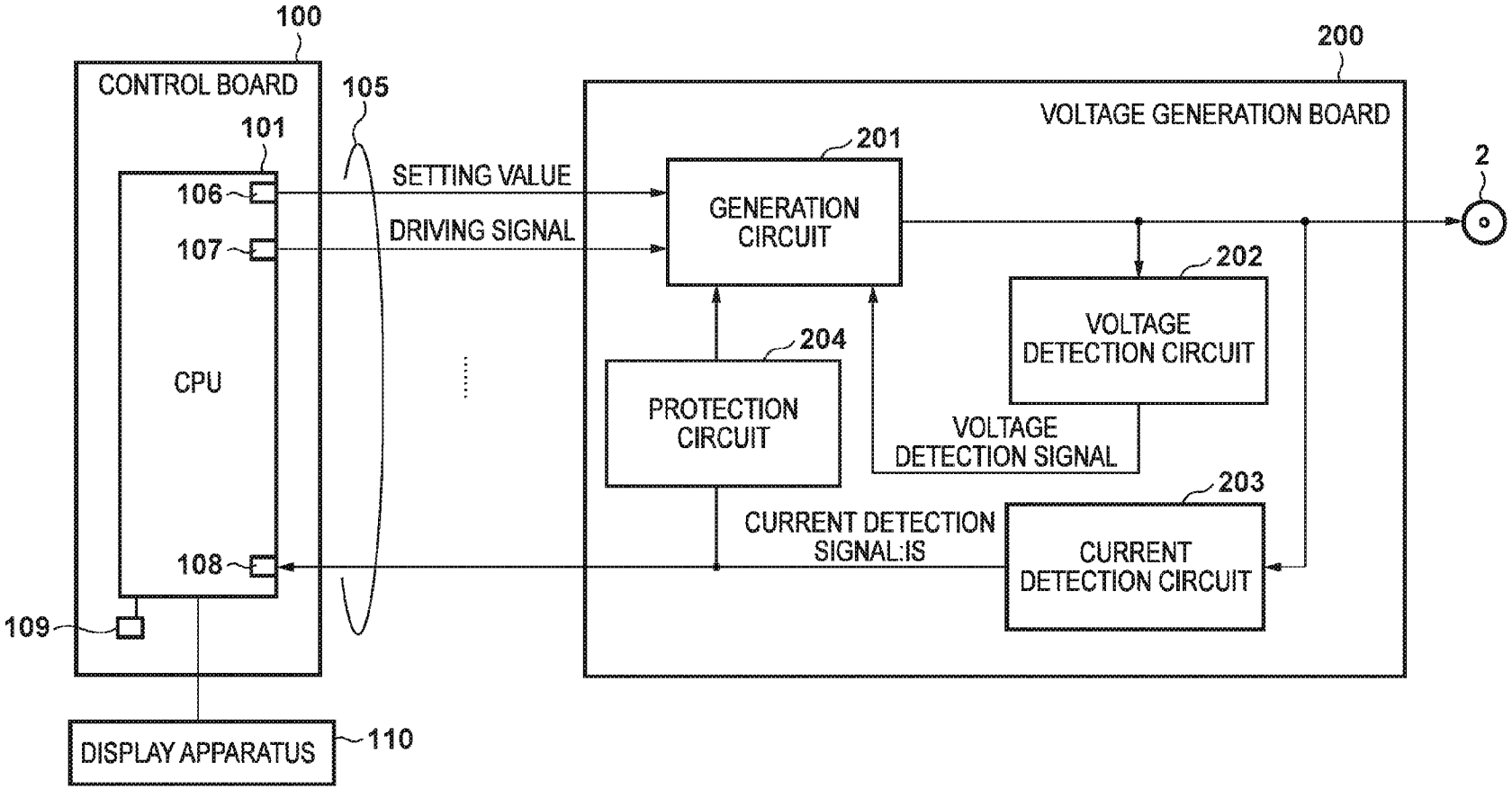
FIG. 2 illustrates a control board and a voltage generation board.

FIG. 2 is a block diagram showing a configuration of a control board 100 on which a control circuit is mounted, and a configuration of a voltage generation board 200 on which a high-voltage generation circuit that generates a high voltage is mounted. The control board 100 includes, for example, a CPU 101 that integrally controls the entire image forming apparatus 10. The CPU 101 outputs a setting value for setting a voltage generated and output by the voltage generation board 200, and also outputs a driving signal for driving a generation circuit 201 of the voltage generation board 200. A setting unit 106 has a function of deciding on and outputting the setting value. A driving unit 107 has a function of generating and outputting the driving signal. The generation circuit 201 is driven by the driving signal output from the control board 100, and generates a predetermined voltage corresponding to the setting value. The generation circuit 201 generates a charging voltage, a developing voltage, a transfer voltage, and the like. Four generation circuits 201 may be provided in one-to-one correspondence with four charging rollers 2, or one generation circuit 201 may be shared among the four charging rollers 2. Alternatively, two generation circuits 201 may be provided in such a manner that one of them supplies a charging voltage to the charging roller 2 corresponding to black, and the other of them corresponds to the remaining three charging rollers 2. A developing voltage may be generated by dividing a charging voltage using a voltage divider circuit, or a generation circuit 201 for a developing voltage may be provided separately from a generation circuit 201 for a charging voltage. Similarly, with regard to a transfer voltage, one or more generation circuits 201 may be provided that are configured in a manner similar to the aforementioned generation circuits 201 for a charging voltage and a developing voltage. In the following description, a voltage generated by the generation circuit 201 is applied to the charging roller 2. Note that by replacing the expression "charging voltage" with "developing voltage" or "transfer voltage", the following description related to a charging voltage serves as a description related to a developing voltage or a transfer voltage.

A voltage detection circuit 202 includes a voltage divider circuit that divides an output voltage generated by the generation circuit 201, and feeds a voltage obtained as a result of voltage division performed by the voltage divider circuit back to the generation circuit 201. The generation circuit 201 includes a comparison circuit that compares the voltage that has been fed back with the setting value, and adjusts the output voltage so that the voltage that has been fed back and the setting value match.

A current detection circuit 203 detects, for example, a current that flows in the charging roller 2 as a result of applying a charging voltage output from the voltage generation board 200 to the charging roller (this current is referred to as a charging current). Specifically, the current detection circuit 203 outputs a current detection signal IS corresponding to the charging current to the CPU 101 and a protection circuit 204. Note that in the following description, the reference sign IS is also used as a reference sign representing a voltage value transmitted by the current detection signal. The CPU 101 includes a port 108 that receives the current detection signal IS. The current detection signal IS will be described below as a voltage value that is inversely proportional to the charging current, but it may instead be a voltage value that is proportional to the charging current. Note that it is sufficient for the current detection signal IS to be a signal that transmits a voltage value that is correlated with the charging current. The current detection signal IS is input to the control board 100, and is used to detect, for example, an attachment error and a current leak of the photosensitive drum 1.

The protection circuit 204 controls the generation circuit 201 so as to reduce an excess current during the occurrence of the excess current. For example, the protection circuit 204 may stop an operation of the generation circuit 201 when the charging current detected by the current detection circuit 203 exceeds a threshold or does not fall in a normal current range. This protects the voltage generation board 200, the charging roller 2, and the photosensitive drum 1 from the excess current.

The control board 100 and the voltage generation board 200 are electrically connected via a cable 105 constituted by a set of bundled wires. The cable 105 includes a power supply line, a signal line for transmitting the setting value, a signal line for transmitting the driving signal, a signal line for transmitting the current detection signal IS, and the like. The cable 105 is provided with connectors at both ends, and the control board 100 and the voltage generation board 200 are also provided with corresponding connectors.

A storage apparatus 109 is a RAM, a ROM, or the like, and stores, for example, thresholds used in determination of errors. A display apparatus 110 displays, for example, an error message. Upon detection of an error on the basis of the current detection signal IS, the CPU 101 generates an error message and causes the display apparatus 110 to display the error message. The error message may include information showing the substance of the error, guidance for resolving the error, and the like.

Figure 3:
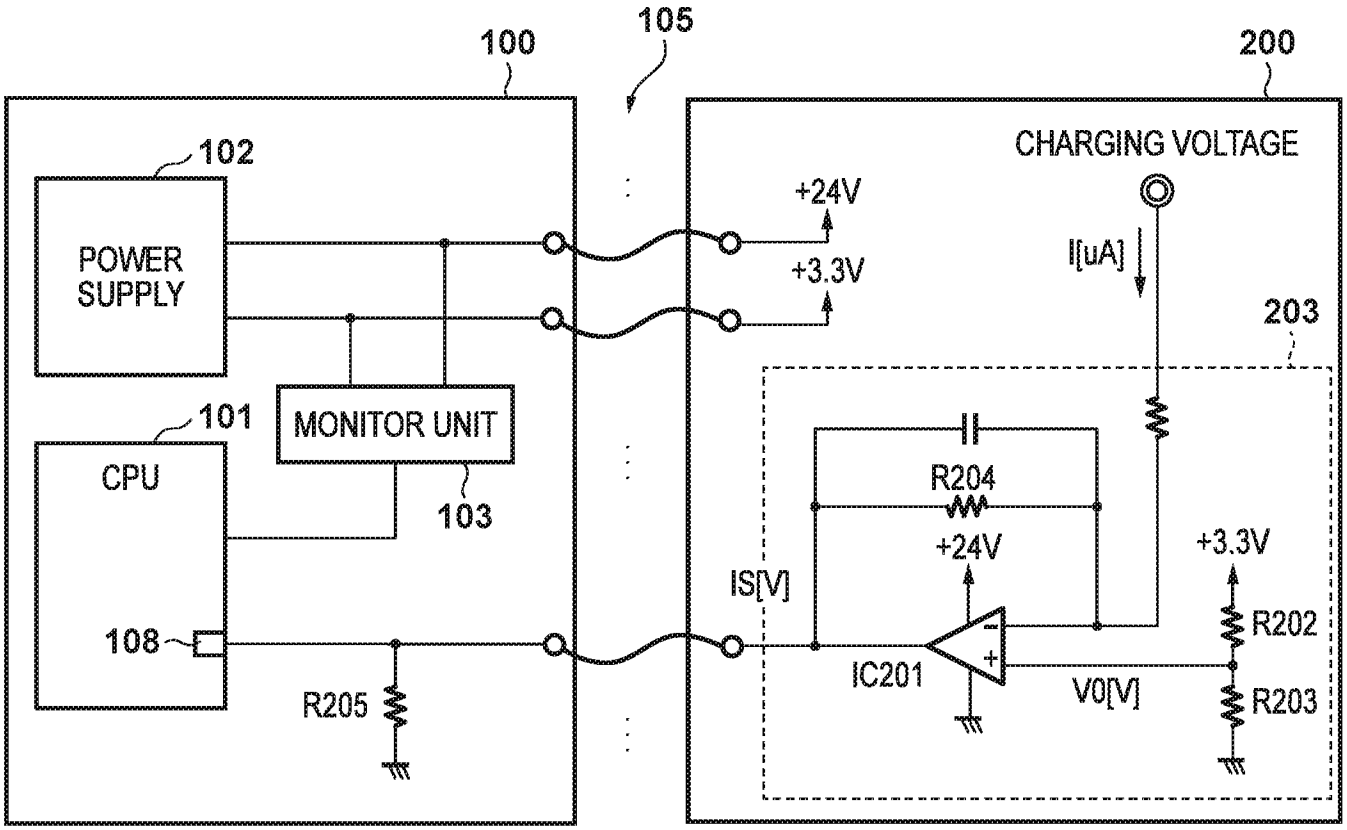
FIG. 3 illustrates the details of the control board and the voltage generation board.

With reference to FIG. 3, the following describes an example configuration of the current detection circuit 203. A power supply 102 of the control board 100 generates a first voltage of +24 V and a second voltage of +3.3 V, and supplies the first and second voltages to the current detection circuit 203. The current detection circuit 203 includes an operational amplifier IC201. The first voltage is used as an operating voltage for the operational amplifier IC201, whereas the second voltage is used as a reference voltage for generating the current detection signal IS. Note that the control board 100 notifies the CPU 101 of the states of the first and second voltages using a monitor unit 103. The notification may deliver, for example, a voltage value of the first voltage and a voltage value of the second voltage as digital values, or whether a voltage value of the first voltage and a voltage value of the second voltage have reached their respective target values.

A positive terminal of the operational amplifier IC201 receives, as an input, a voltage V0 [V] that is generated by dividing the second voltage using a voltage divider circuit formed by resistors R202 and R203. An output from the operational amplifier IC201 is fed back to a negative terminal of the operational amplifier IC201 via a resistor R204. Thus, the negative terminal of the operational amplifier IC201 has a voltage of V0 [V]. A current I [μA] that flows in the charging roller 2 flows to an output terminal of the operational amplifier IC201 via the resistor R204. As the negative terminal of the operational amplifier IC201 has a voltage of V0 [V], a voltage IS [V] of the output terminal of the operational amplifier IC201 is given by the following expression.

$$IS[V]=V0[V]-R204[M\Omega]\times I[\mu A]$$

In the present embodiment, for ease of explanation, the following relationships hold: R202=3 [kΩ], R203=30 [kΩ], and R204=20 [kΩ]. Therefore, the relationship V0=3 [V] holds, and a detected current value IS [V], which is correlated with a value of the current I [μA], has the following values.

(a) When I=0 [μA], IS=3−0.2×0=3 [V]
(b) When I=40 [μA], IS=3−0.2×40=2.2 [V]
(c) When I=100 [μA], IS=3−0.2×100=1 [V]
(d) When I=150 [μA], IS=3−0.2×150=0 [V]

Note that when the relationship IS≤1 [V] (I≥100 [μA]) holds, the protection circuit 204 stops the generation circuit 201. Therefore, the condition set in the above (d) does not occur. However, when the protection circuit 204 is not provided, the condition set in the above (d) occurs.

When the cable 105 for connecting the control board 100 and the voltage generation board 200 is in a disconnected state, the CPU 101 detects 0 [V] as the current detection signal IS. This is because the port that receives the current detection signal IS is earthed via a resistor R205. In view of this circuit condition, the relationship IS≤1 [V] (I≥100 [μA]) holds when abnormal connection (a connection error) has occurred.

Figure 4:
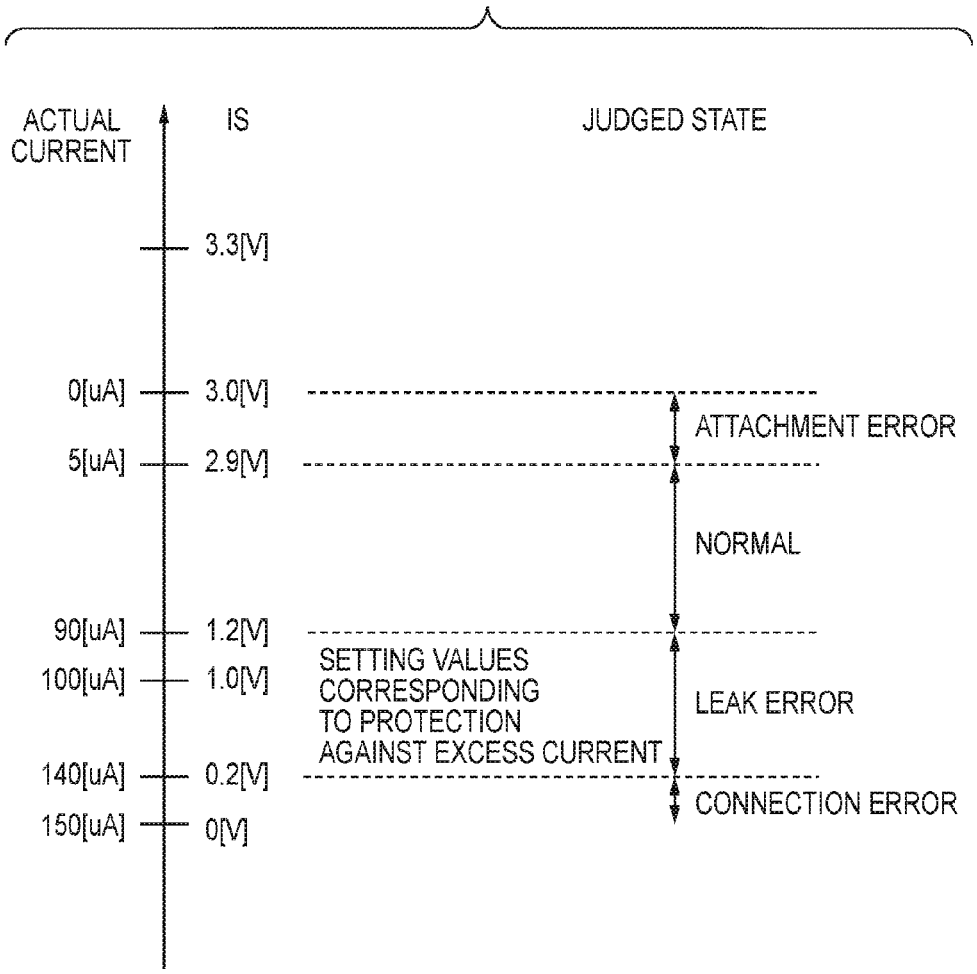
FIG. 4 illustrates types of errors and corresponding current ranges.

FIG. 4 shows relationships among detected current values IS, charging currents (actual currents), and the states judged by the control board 100. Note that the image forming apparatus 10 according to the present embodiment is of a direct-current (DC) charging type.

(1) Connection Error (of Cable)

A connection error denotes a state in which the cable 105 for connecting the control board 100 and the voltage generation board 200 is not appropriately connected. When the connection error has occurred, the charging current could possibly be an excess current exceeding 140 [μA]; however, in this case, the protection circuit 204 operates. Note that when the charging current falls in a current range exceeding 140 [μA], the CPU 101 may determine that the connection error has occurred.

(2) Leak Error

When, for example, condensation forms in the photosensitive drum 1, a resistance value of a load becomes extremely small relative to the voltage generation board 200, and a current leak occurs. If an excessive current flows in the photosensitive drum 1, the potential of the surface of the photosensitive drum 1 deviates from a desired potential, thus leading to formation of an abnormal image and scattering of a developer. Furthermore, the photosensitive drum 1 and other components could possibly be damaged. For example, when the charging current falls in a range that is equal to or smaller than 140 [μA] and exceeds 90 [μA], the CPU 101 determines that the leak error has occurred.

(3) Normal

At the start of application of the charging voltage, the charging current is approximately 40 [μA], although it varies depending on the durability and environmental conditions of the photosensitive drum 1. For example, when the charging current falls in a range that is equal to or smaller than 90 [μA] and exceeds 5 [μA], the CPU 101 determines that errors associated with charging have not occurred (normal).

(4) Attachment Error (Photosensitive Drum in Detached State or Inappropriately Attached State)

In some cases, the photosensitive drum 1 is manufactured as a process cartridge attachable to and detachable from the image forming apparatus 10. With the deterioration of the photosensitive drum 1, the whole process cartridge is replaced. When the photosensitive drum 1 is not attached, there is no path for a current from the voltage generation board 200, and thus no charging current is generated even if the voltage generation board 200 applies the charging voltage to the charging roller 2. No charging current is generated also when the photosensitive drum 1 does not rotate due to the inappropriate attachment of the photosensitive drum 1. The charging current flows in a nip portion formed between the photosensitive drum 1 and the charging roller 2. That is to say, the amount of the charging current corresponds to a difference (voltage) between the potential of the charging roller 2 and the potential of the surface of the photosensitive drum 1. Therefore, although an extremely small charging current is generated at the moment of application of the charging voltage, the foregoing difference soon disappears, ending up in a state where no charging current is generated. In recent years, more products allow general users to replace the photosensitive drum 1. As general users are often unfamiliar with the replacement of the photosensitive drum 1, there is a possibility that they leave the photosensitive drum 1 in a detached state or in an inappropriately attached state. In view of this, it can be said that the detection of an attachment error is important. For example, when the charging current falls in a current range that is equal to or smaller than 5 [μA] and exceeds 0 [μA], the CPU 101 determines that the attachment error has occurred.

In the present embodiment, determination is made using the current detection signal IS for transmitting a voltage that is inversely proportional to the charging current. In this case, the errors and the current detection signal IS have the following relationships.

Figure 5:
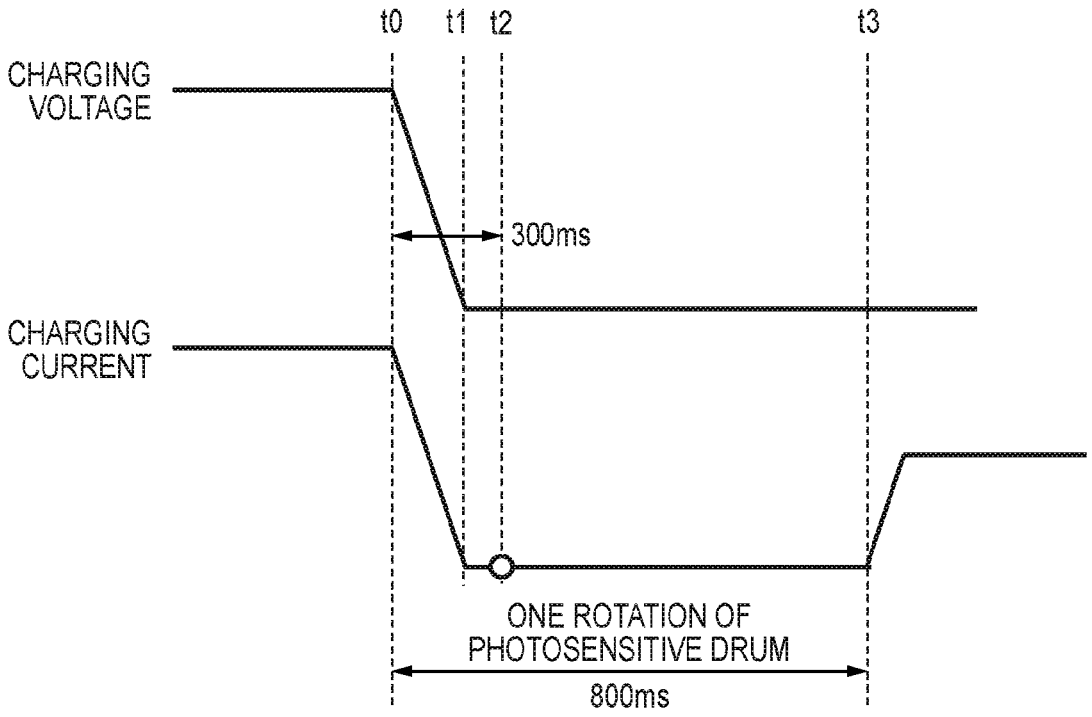
FIG. 5 illustrates timings related to a judgment about errors.

0.2 [V]≥IS: connection error 1.2 [V]≥IS>0.2 [V]: leak error 2.9 [V]≥IS>1.2 [V]: normal state IS>2.9 [V]: attachment error With reference to FIG. 5, the following describes timings related to detection of the charging current. The CPU 101 preliminarily controls the photosensitive drum 1 to rotate at a fixed rotation speed. At timing t0, the generation circuit 201 starts outputting the charging voltage. At timing t1, the charging voltage stabilizes. A portion of the surface of the photosensitive drum 1 that is located at a position of application of the charging voltage at timing t0 arrives at the position of application of the charging voltage again at timing t3. In other words, one rotation of the photosensitive drum 1 takes place between timing t0 and timing t3.

The charging current varies depending on a potential difference at the nip portion formed between the photosensitive drum 1 and the charging roller 2. Therefore, the charging current cannot be detected accurately in a time period from timing t0 at which the output of the charging voltage is started to timing t1 at which the charging voltage reaches a target voltage and stabilizes. Furthermore, the charging current cannot be detected accurately also at and after timing t3 at which one rotation of the photosensitive drum 1 is completed. That is to say, the charging current can be detected accurately in a time period from timing t1 to timing t3.

A time period from timing t0 to timing t1 is approximately 200 ms. A time period from timing t0 to timing t3 is approximately 800 ms. In view of this, in the present embodiment, the CPU 101 reads out the current detection signal IS indicating the charging current at timing t2 at which a predetermined time period (e.g., 300 ms) has elapsed since timing t0, and identifies the aforementioned four states on the basis of the current detection signal IS.

Figure 6:
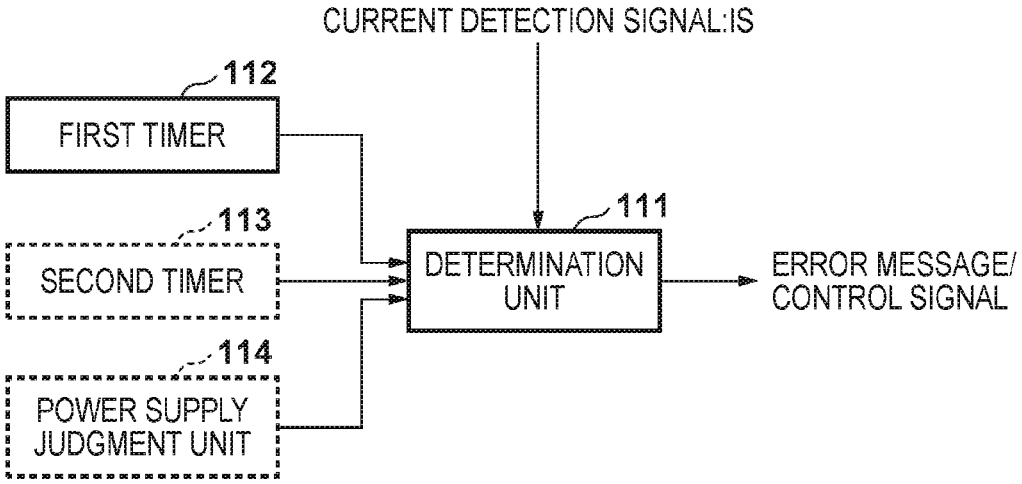
FIG. 6 illustrates functions involved with determination of errors.

FIG. 6 shows functions that are realized by the CPU 101 executing a program. These functions may be realized by hardware, such as an application-specific integrated circuit (ASIC). A part of these functions may be realized by the CPU, and the remaining functions may be realized by hardware.

A determination unit 111 determines an error in accordance with a current range in which the current detected by the current detection circuit 203 falls, the current range being included among a plurality of current ranges that are in one-to-one correspondence with a plurality of errors. This current may be any one of a charging current, a developing current, and a transfer current. A first timer 112 measures an elapsed time period since the control board 100 issued an instruction for generating the predetermined voltage to the voltage generation board 200. When the elapsed time period measured by the first timer 112 exceeds the predetermined time period, the determination unit 111 may determine an error on the basis of the current detected by the current detection circuit 203. When the power supply 102 supplies a normal operating voltage, a second timer 113 repeatedly measures a fixed time period. A power supply judgment unit 114 judges whether the operating voltage supplied from the power supply 102 to the voltage generation board 200 is normal. The power supply judgment unit 114 receives information related to the operating voltage from the monitor unit 103.

Figure 7:
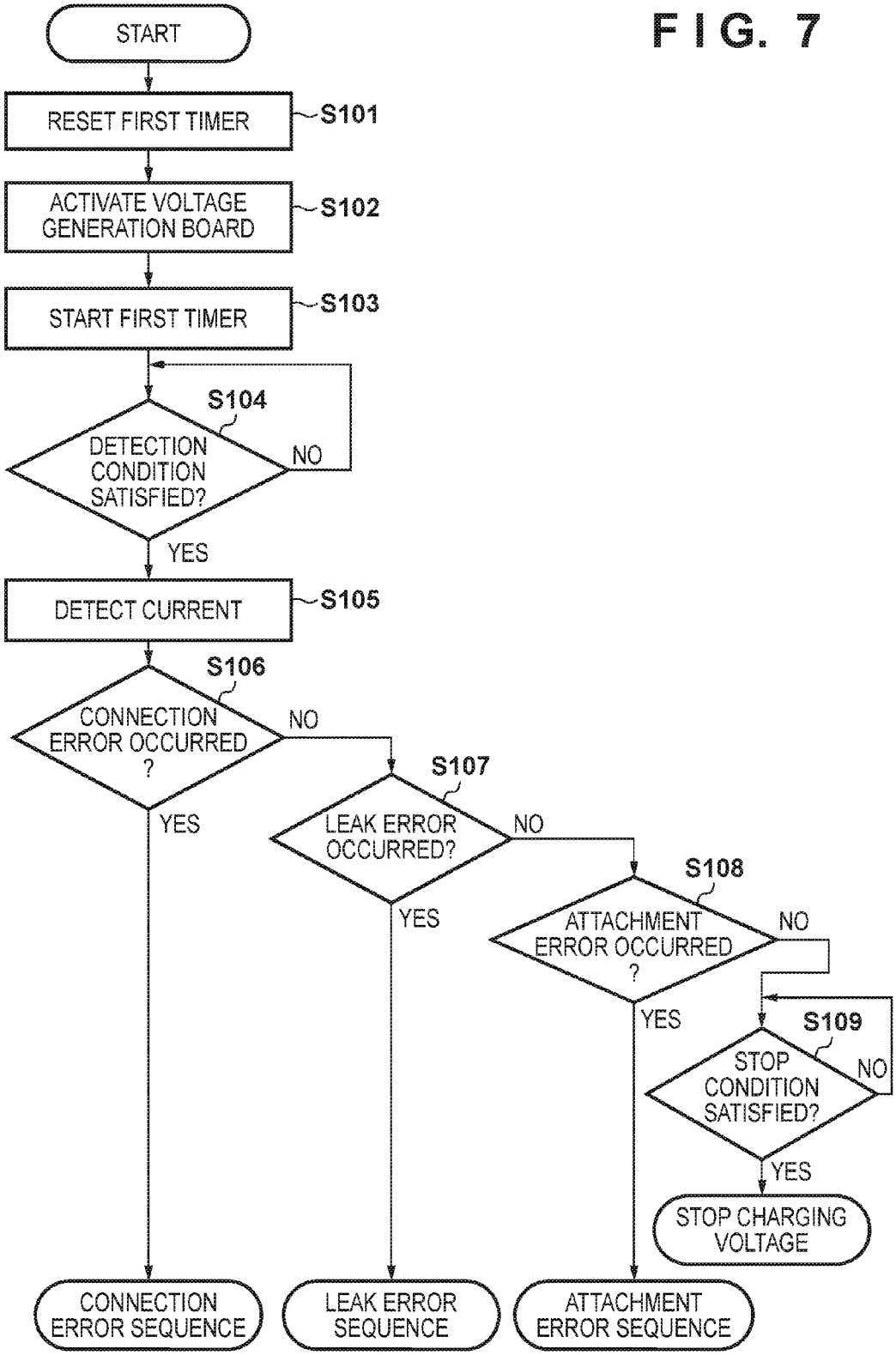
FIG. 7 is a flowchart showing an error determination sequence.

With reference to FIG. 7, the following describes a current detection sequence executed when the charging voltage is activated. When electric power is supplied from a commercial power supply to the image forming apparatus 10, the CPU 101 executes an activation sequence. This activation sequence may include the current detection sequence. Alternatively, the CPU 101 may start the current detection sequence when an image forming instruction is issued by a user.

In step S101, the CPU 101 resets a value measured by the first timer 112 to zero. In step S102, the CPU 101 activates the voltage generation board 200. For example, the setting unit 106 of the CPU 101 outputs the setting value. Furthermore, the driving unit 107 of the CPU 101 starts outputting the driving signal. The CPU 101 preliminarily controls the power supply 102 so that the power supply 102 supplies the operating voltage to the voltage generation board 200. In step S103, the CPU 101 causes the first timer 112 to start the measurement.

In step S104, the CPU 101 judges whether a detection condition is satisfied. The detection condition is, for example, a state in which the voltage output from the voltage generation board 200 has stabilized. As explained with reference to FIG. 5, the detection condition may be a state in which an elapsed time period since timing t0, at which the output of the voltage is started, is equal to or longer than the predetermined time period. The predetermined time period is, for example, 300 ms. The predetermined time period is obtained by adding a margin time period to the time period from timing t0 to timing t1.

Consequently, an accurate current can be detected at timing t2 at which the voltage has sufficiently stabilized. When the detection condition is satisfied, the CPU 101 proceeds to step S105.

In step S105, the CPU 101 detects the current that has flowed in a load (e.g., the charging roller 2) connected to the voltage generation board 200. For example, the CPU 101 receives the current detection signal IS that has been output from the current detection circuit 203 as a result of detecting the charging current.

In step S106, the CPU 101 (determination unit 111) judges whether the connection error has occurred on the basis of the result of current detection. As explained with reference to FIG. 4, when the current detection signal IS is equal to or smaller than 0.2 [V] (meaning that the charging current exceeds 140 [μA]), the determination unit 111 determines that the connection error has occurred. When the connection error has occurred, the CPU 101 executes a connection error sequence. For example, the CPU 101 causes the driving unit 107 to stop outputting the driving signal, and outputs an error message indicating that the connection error has occurred to the display apparatus 110. When the connection error has not occurred, the CPU 101 proceeds to step S107.

In step S107, the CPU 101 (determination unit 111) judges whether the leak error has occurred on the basis of the result of current detection. As explained with reference to FIG. 4, when IS is larger than 0.2 [V] and is equal to or smaller than 1.2 [V] (meaning that the charging current is equal to or smaller than 140 [μA] and exceeds 90 [μA]), the determination unit 111 determines that the leak error has occurred. When the leak error has occurred, the CPU 101 executes a leak error sequence. For example, the CPU 101 causes the driving unit 107 to stop outputting the driving signal, and outputs an error message indicating that the leak error has occurred to the display apparatus 110. When the leak error has not occurred, the CPU 101 proceeds to step S108.

In step S108, the CPU 101 (determination unit 111) judges whether the attachment error has occurred on the basis of the result of current detection. As explained with reference to FIG. 4, when IS exceeds 2.9 [V] (meaning that the charging current is equal to or smaller than 5 [μA]), the determination unit 111 determines that the attachment error has occurred. When the attachment error has occurred, the CPU 101 executes an attachment error sequence. For example, the CPU 101 causes the driving unit 107 to stop outputting the driving signal, and outputs an error message indicating that the attachment error has occurred to the display apparatus 110. An example of the error message is "please set a drum". When the attachment error has not occurred, the CPU 101 proceeds to step S109. As explained with reference to FIG. 4, when IS is larger than 1.2 [V] and is equal to or smaller than 2.9 [V] (meaning that the charging current is equal to or smaller than 90 [μA] and exceeds 5 [μA]), the determination unit 111 determines that no error has occurred (normal).

In step S109, the CPU 101 judges whether a stop condition for stopping the charging voltage is satisfied. The stop condition is, for example, a state in which the activation sequence has ended, or a state in which an image forming job has ended.

As described above, in the present embodiment, the current detection signal IS that is used to detect, for example, the attachment error of the photosensitive drum is also used for another purpose, or more specifically, to enable detection of the connection error. The present embodiment is also advantageous in that it is unnecessary to increase the number of dedicated circuits and signal lines for detection of the connection error.

Second Embodiment

In the first embodiment, the CPU 101 detects the four states using the charging current in the same sequence. The present embodiment describes an example in which only the detection of the connection error is carried out separately in a sequence II. Note that the remaining three states are detected in a sequence I that is similar to the sequence described in the first embodiment. The connection error can be determined as long as operating voltages of +24 V and +3.3 V are supplied to the voltage generation board 200. In other words, the CPU 101 can make a judgment about the connection error on the basis of the current detection signal IS, even if the voltage generation board 200 does not generate the charging voltage. Therefore, the sequence II can be separated from the sequence described in the first embodiment. As a result, the CPU 101 can detect the connection error even before starting image formation, that is to say, before outputting the charging voltage. This means that the connection error can be detected at an early timing compared to the first embodiment. In addition, burdens on various components, such as rollers, electric components, and process units, are alleviated.

Figure 8:
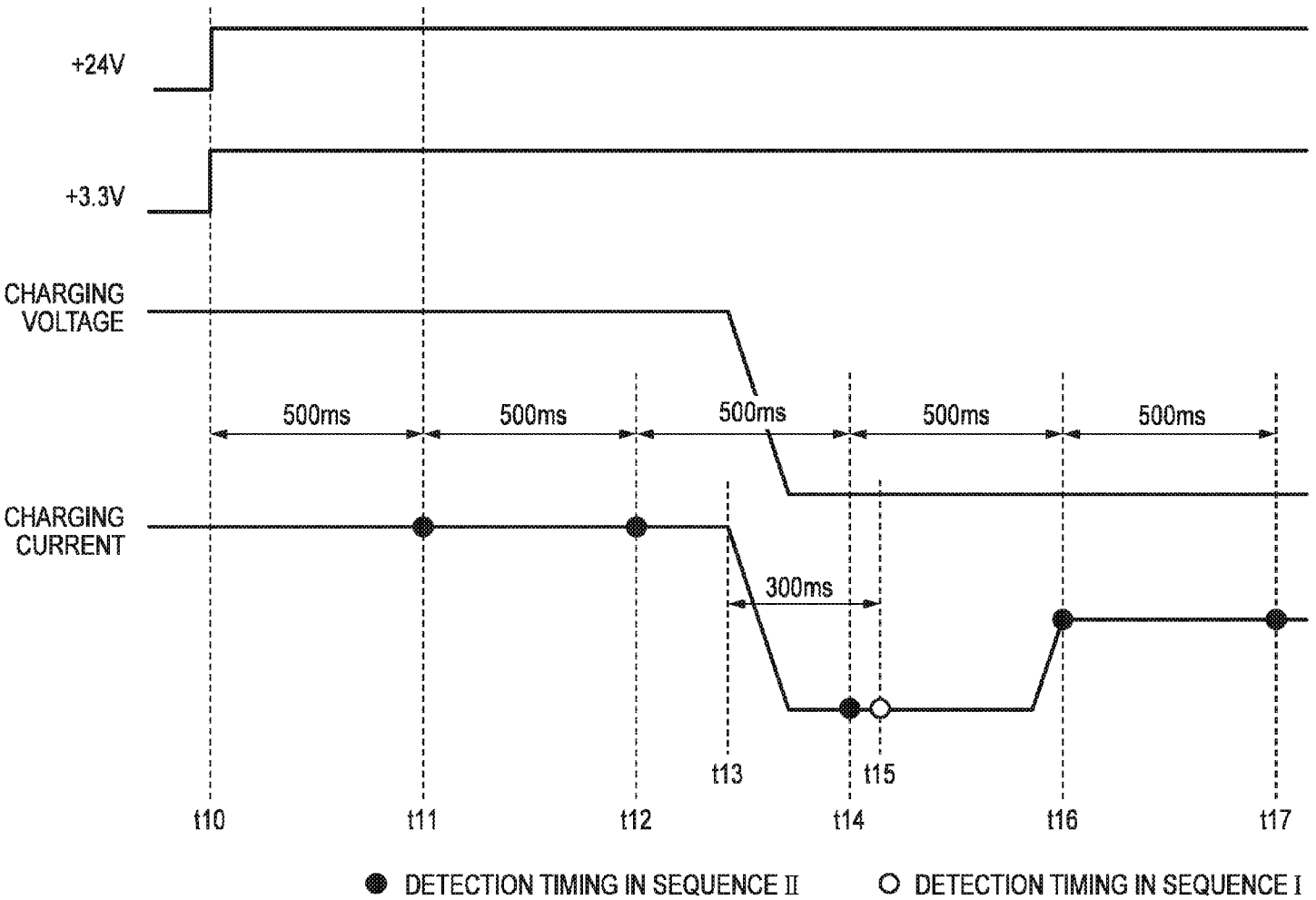
FIG. 8 illustrates timings related to a judgment about errors.

FIG. 8 shows timings related to detection of the charging current according to the second embodiment. When the power supply judgment unit 114 detects the raised states of the operating voltages of +3.3 V and +24 V via the monitor unit 103, it causes the second timer 113 to repeatedly measure the fixed time period. The normally raised states of the operating voltages are achieved at timing t10. The fixed time period is, for example, 500 ms. The CPU 101 obtains the current detection signal IS each time the second timer 113 measures the fixed time period. Referring to FIG. 8, the current detection signal IS is obtained at timings t10, t11, t12, t14, t16, and t17. On the basis of the current detection signal IS, the determination unit 111 judges whether the connection error has occurred. This determination process is the same as the process of step S106. When the connection error has occurred, the CPU 101 executes the connection error sequence.

Meanwhile, when the output of the charging voltage is started in response to a trigger, e.g., image formation, the CPU 101 detects an error in accordance with the sequence I. As stated earlier, the determination unit 111 determines whether an error has occurred at timing t15 at which the predetermined time period (e.g., 300 ms) has elapsed since timing t13 at which the output of the charging voltage is started. That is to say, the state of the image forming apparatus 10 is categorized as one of the attachment error, the leak error, and normal.

Figure 9:
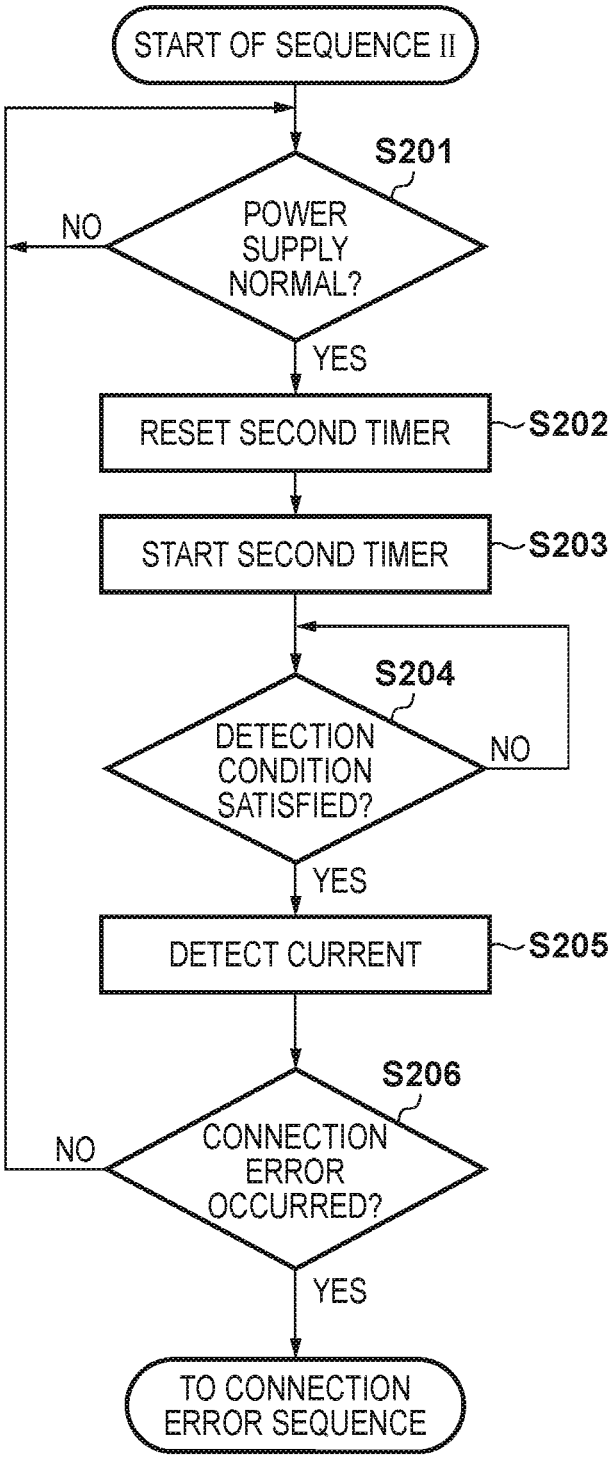
FIG. 9 is a flowchart showing an error determination sequence II.
Figure 10:
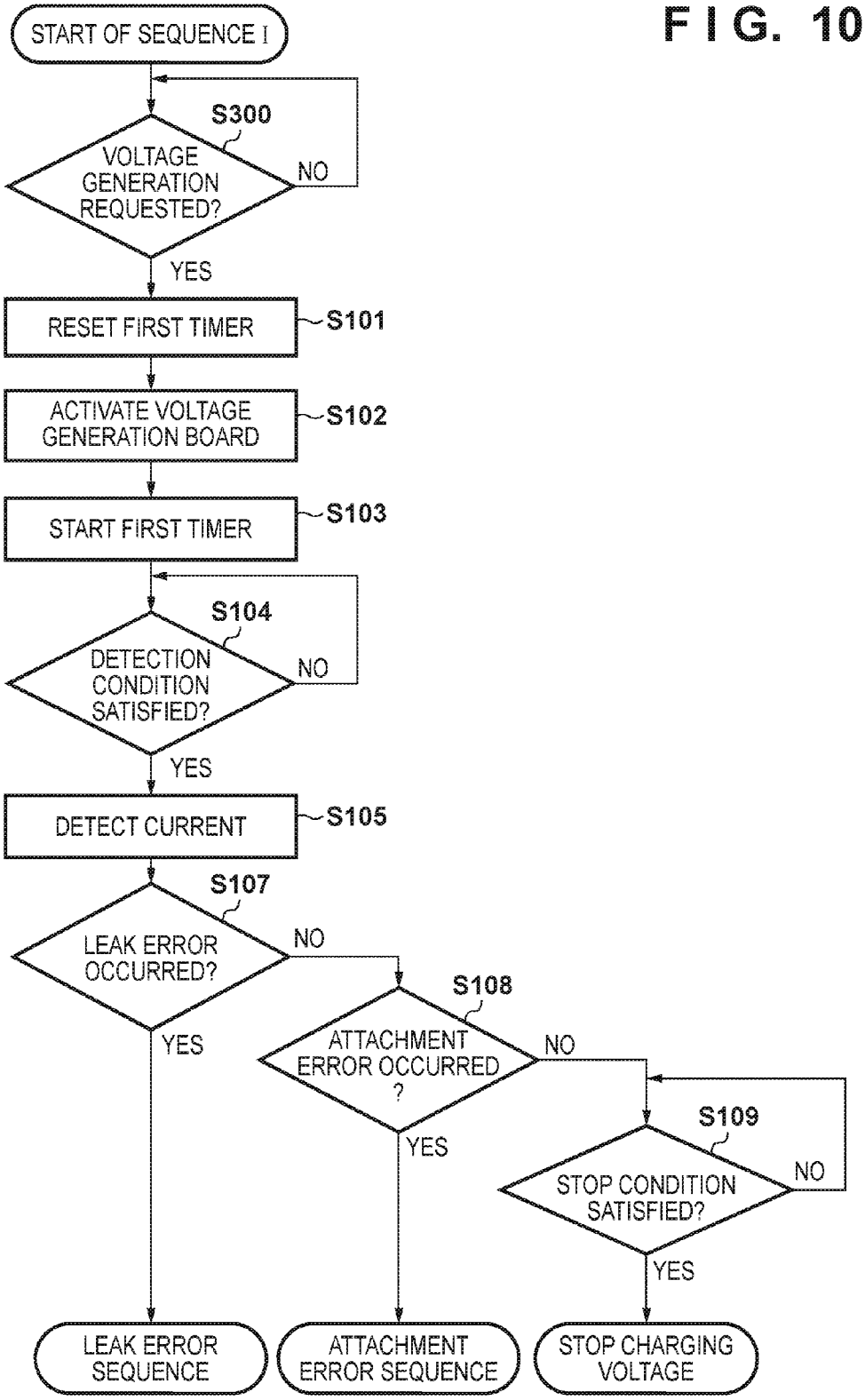
FIG. 10 is a flowchart showing an error determination sequence I.

FIG. 9 is a flowchart showing the sequence II according to the second embodiment. FIG. 10 is a flowchart showing the sequence I according to the second embodiment. Note that as explained with reference to FIG. 8, when the image forming apparatus 10 is activated by a supply of electric power from a commercial power supply, the CPU 101 executes the sequence I and the sequence II in parallel.

In step S201, the CPU 101 (power supply judgment unit 114) judges whether the power supply 102 is normally generating the operating voltages for the voltage generation board 200. For example, when the power supply judgment unit 114 detects the raised states of the operating voltages of +3.3 V and +24 V via the monitor unit 103, it judges that the power supply 102 is normally generating the operating voltages. When the power supply 102 is normal, the CPU 101 proceeds to step S202. In step S202, the CPU 101 resets the second timer 113. In step S203, the CPU 101 starts the second timer 113.

In step S204, the CPU 101 judges whether a detection condition is satisfied. The detection condition is, for example, a state in which a time period measured by the second timer 113 exceeds a predetermined time period (e.g., 500 ms). When the detection condition is satisfied, the CPU 101 proceeds to step S205. In step S205, with the use of the current detection circuit 203, the CPU 101 detects the current that flows in a load (e.g., the charging roller 2). For example, the CPU 101 receives the current detection signal IS from the current detection circuit 203. Note that the current detection circuit 203 can operate as long as the operating voltages of +3.3 V and +24 V are supplied, even if the generation circuit 201 is not activated. The CPU 101 can thus execute the sequence II for detecting the connection error.

In step S206, the CPU 101 judges whether the connection error has occurred. As step S206 is similar to step S106, a detailed description thereof is omitted. When the connection error has not occurred, the CPU 101 returns to step S201. When the connection error has occurred, the CPU 101 executes the aforementioned connection error sequence. By thus repeating steps S201 to S206, the connection error can be detected during every fixed time period.

With reference to FIG. 10, the following describes the sequence I. As apparent from comparison between FIG. 6 and FIG. 10, step S106 shown in FIG. 6 is omitted in the sequence I. Therefore, after step S105, the CPU 101 proceeds to step S107. In addition, prior to step S101, step S300 is executed to make a judgment about a condition for starting the sequence II.

In step S300, the CPU 101 judges whether a request to generate a voltage using the voltage generation board 200 has been issued. The request is, for example, a user's instruction for carrying out image formation. As stated earlier, the CPU 101 may issue the request in the activation sequence. Upon the issuance of the request, the CPU 101 executes the aforementioned processes of step S101 and subsequent steps. As the processes of step S101 and subsequent steps have already been described, a description thereof is omitted here.

The aforementioned introduction of the sequence II enables the CPU 101 to determine the connection error also in a time period in which no voltage is generated by the generation circuit 201. In a time period in which a voltage is generated by the generation circuit 201, the CPU 101 can detect the attachment error and the leak error of the photosensitive drum 1 by executing the sequence I.

<Summary>

As described above, the current detection circuit 203 detects a current that flows in one of loads including the charging roller 2, the development sleeve 11 of the developer 4, the primary transfer roller 6, and the secondary transfer roller 7. The determination unit 111 determines an error in accordance with a current range in which the current detected by the current detection circuit 203 falls, the current range being included among a plurality of current ranges that are in one-to-one correspondence with a plurality of errors. The determination unit 111 may determine a connection error of the cable 105 and an attachment error of a load depending on whether the current detected by the current detection circuit 203 falls in a current range corresponding to the connection error of the cable or a current range corresponding to the attachment error of the load. For example, a connection error between the control board 100 and the voltage generation board 200 can be determined with the use of the current detection signal IS of the voltage generation board 200 that is used to detect, for example, an attachment error of the photosensitive drum 1. As the function of detecting the charging current and the like is used for multiple purposes in the above-described manner, not only an attachment error and a leak error but also a connection error can be detected. Therefore, the present embodiments can provide a connection detection method that is advantageous in terms of space on the boards and manufacturing cost. That is to say, a connection error between the control board 100 and the voltage generation board 200 can be detected, and a time period required to specify a site of an error can be shortened, without increasing the number of circuits and signal lines for error detection.

As explained with reference to FIG. 6, the first timer 112 may be provided that measures an elapsed time period since the control board 100 issued an instruction for generating the predetermined voltage to the voltage generation board 200. When the elapsed time period measured by the first timer 112 exceeds a predetermined time period (e.g., 300 ms), the determination unit 111 may determine an error on the basis of the current detected by the current detection circuit 203. Note that the predetermined time period may be equal to or longer than a time period from when the control board 100 issues an instruction for generating the predetermined voltage to when the predetermined voltage stabilizes (the voltage generated by the generation circuit 201 reaches the predetermined voltage). Using such a predetermined time period makes accurate the value of the current detected by the current detection circuit 203, thereby improving the precision of error detection. Note that the predetermined time period is decided on through simulations and experiments as it depends on a configuration of the image forming apparatus 10 and circuit configurations.

A plurality of errors determined by the determination unit 111 include at least one of a connection error of the cable 105, a current leak (leak error), and an attachment error of an image carrier. As the determination unit 111 can detect various errors on the basis of the current detected by the current detection circuit 203, usability is improved. Examples of the image carrier include the photosensitive drum 1 and the intermediate transfer belt 5. An error associated with the intermediate transfer belt 5 can also be detected on the basis of a transfer current that flows in the secondary transfer roller 7.

As explained with reference to FIG. 4, when the current detected by the current detection circuit 203 exceeds a first threshold (e.g., 140 [μA]), the determination unit 111 may determine that the connection error has occurred. When the current detected by the current detection circuit 203 is equal to or smaller than the first threshold and exceeds a second threshold (e.g., 90 [μA]) that is smaller than the first threshold, the determination unit 111 may determine that the leak error has occurred. The protection circuit 204 may be provided as an excess current protection unit that operates to reduce an excess current when the current detected by the current detection circuit 203 is equal to or smaller than the first threshold and exceeds the second threshold. In this way, damage to circuit components, the photosensitive drum 1, roller members, and the like can be reduced.

As explained with reference to FIG. 4, there is a case in which the current detected by the current detection circuit 203 is equal to or smaller than the second threshold and exceeds a third threshold (e.g., 5 [μA]) that is smaller than the second threshold. In this case, the determination unit 111 may determine that the connection error of the cable, the current leak, and the attachment error of the image carrier have not occurred. The determination unit 111 may make such a specific determination about a normal state as well.

As explained with reference to FIG. 4, when the current detected by the current detection circuit 203 is equal to or smaller than the third threshold, the determination unit 111 may determine that the attachment error has occurred. When the photosensitive drum 1 is not attached, a current does not flow from the charging roller 2 to the photosensitive drum 1. Therefore, using such a threshold enables precise detection of the attachment error.

As explained with reference to FIG. 6 and FIGS. 8 to 10, the control board 100 may include the power supply 102, the monitor unit 103, and the second timer 113. In particular, when an operating voltage is normally supplied, the second timer 113 repeatedly measures a fixed time period (e.g., 500 ms). Each time the second timer 113 measures the fixed time period, the determination unit 111 may determine the connection error in accordance with the current detected by the current detection circuit 203, irrespective of the state of voltage generation in the voltage generation board 200. That is to say, using the sequence II enables detection of the connection error irrespective of the state of voltage generation in the voltage generation board 200. In other words, as the connection error can be detected at an earlier timing, usability is further improved. Note that the fixed time period is decided on through simulations and experiments as it depends on a configuration of the image forming apparatus 10 and circuit configurations. As explained with reference to FIGS. 5 and 8, among the plurality of errors, the connection error of the cable can be determined by the determination unit 111 using the current that is detected by the current detection circuit 203 during a supply of an operating voltage to the voltage generation board 200. On the other hand, among the plurality of errors, an error different from the connection error of the cable can be determined by the determination unit 111 using the current that is detected by the current detection circuit 203 while the voltage output from the voltage generation board 200 is maintained at the predetermined voltage.

The fixed time period (e.g., 500 ms) may be set to be longer than a time period (e.g., 300 ms) from when the control board 100 issues an instruction for generating the predetermine voltage to when the predetermined voltage stabilizes, and shorter than a time period (e.g., 800 ms) of one rotation of the photosensitive drum 1. This enables reliable detection of the attachment error and the leak error in the sequence I.

Although the above embodiments deal with, as an example, the charging voltage applied to the charging roller 2, the present invention is also applicable to other high-voltage outputs and signals other than the high-voltage outputs. In addition, the above embodiments deal with one charging voltage. However, the present invention is also applicable to a case in which one voltage generation board 200 outputs a plurality of voltages (e.g., a case in which charging voltages are output in one-to-one correspondence with Y, M, C, and K). In this case, when all of the determination results for Y, M, C, and K indicate the possibility of a connection error, the determination unit 111 may determine that the connection error has occurred. Consequently, the connection error can be determined with higher precision.

Figure 11:
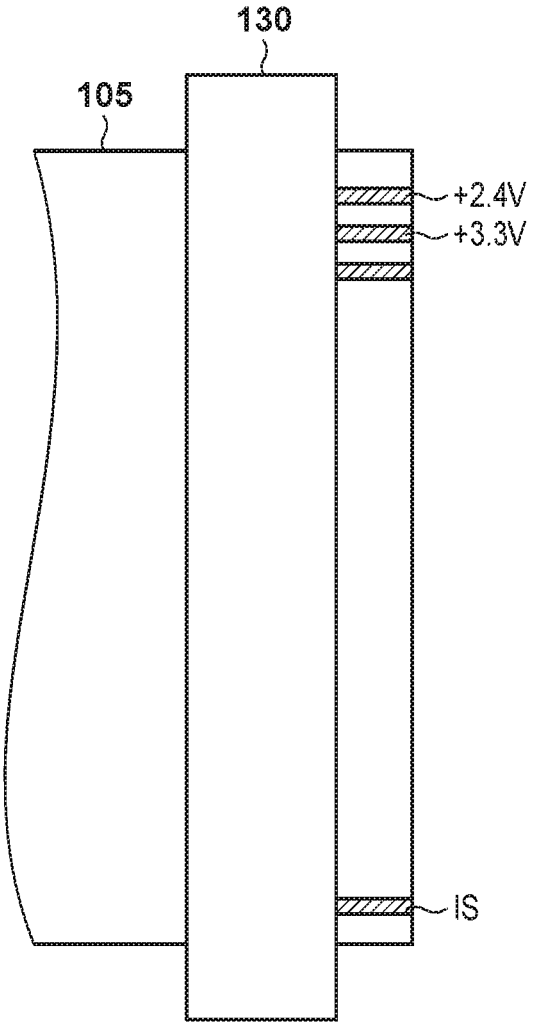
FIG. 11 illustrates the arrangement of terminals.

The above embodiments do not explicitly describe the arrangement of pins for connectors corresponding to the current detection signal IS, +3.3 V, and +24 V. As shown in FIG. 11, a connector 130 attached to the cable 105 may be provided with terminals for transmitting +3.3 V and +24 V at one end, and a terminal for transmitting the current detection signal IS at the other end. This enables high-precision detection of a connection error attributed to a diagonal insertion of the connector 130. This is because the diagonal insertion of the connector 130 blocks the supply of an operating voltage, or blocks the transmission of the current detection signal IS. In either case, the current detection signal IS has an amplitude of 0 [V], thereby enabling the determination unit 111 to detect the connection error with high precision. Although one current detection signal IS is used in the above embodiments, a plurality of current detection signals IS may be used. In this case, for example, current detection signals IS may be prepared in one-to-one correspondence with Y, M, C, and K. This case also enables the determination unit 111 to detect the connection error with high precision by providing the other end with terminals for the plurality of current detection signals IS.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-004514, filed Jan. 13, 2015, which is hereby incorporated by reference herein in its entirety.

What is claimed is:

1. An image forming apparatus comprising:

an image carrier;

an image forming unit configured to form a toner image on the image carrier, and transfer the toner image to a recording medium;

a voltage generation circuit configured to generate a high voltage used for the image forming unit;

a control circuit that is connected to the voltage generation circuit via a cable, and configured to control the high voltage generated by the voltage generation circuit;

a detection unit configured to detect a current flowing in a load of the image forming unit to which the high voltage generated by the voltage generation circuit is applied; and a determination unit configured to determine an error in accordance with a current range in which the current detected by the detection unit falls, the current range being included among a plurality of current ranges that are in one-to-one correspondence with a plurality of errors.

2. The image forming apparatus according to claim 1, further comprising a measurement unit configured to measure an elapsed time period since issuance of an instruction for generating a predetermined voltage from the control circuit to the voltage generation circuit, wherein when the elapsed time period measured by the measurement unit exceeds a predetermined time period, the determination unit determines an error on the basis of the current detected by the detection unit.

3. The image forming apparatus according to claim 2, wherein the predetermined time period is equal to or longer than a time period from when the control circuit issues the instruction for generating the predetermined voltage to when the voltage generated by the voltage generation circuit reaches the predetermined voltage.

4. The image forming apparatus according to claim 1, wherein the plurality of errors include at least one of a connection error of the cable, a leak of the current, and an attachment error of the image carrier.

5. The image forming apparatus according to claim 4, wherein when the current detected by the detection unit exceeds a first threshold, the determination unit determines that the connection error of the cable has occurred.

6. The image forming apparatus according to claim 5, wherein when the plurality of errors include the leak of the current, and when the current detected by the detection unit is equal to or smaller than the first threshold and exceeds a second threshold, the determination unit determines that the leak of the current has occurred, the second threshold being lower than the first threshold.

7. The image forming apparatus according to claim 6, further comprising:

an excess current protection unit configured to operate to reduce an excess current when the current detected by the detection unit is equal to or lower than the first threshold and exceeds the second threshold.

8. The image forming apparatus according to claim 6, wherein when the current detected by the detection unit is equal to or lower than the second threshold and exceeds a third threshold, the determination unit determines that the connection error of the cable, the leak of the current, and the attachment error of the image carrier have not occurred, the third threshold being lower than the second threshold.

9. The image forming apparatus according to claim 8, wherein when the current detected by the detection unit is equal to or lower than the third threshold, the determination unit determines that the attachment error of the image carrier has occurred.

10. The image forming apparatus according to claim 1, further comprising:

a power supply unit configured to supply an operating voltage to the voltage generation circuit;

a monitor unit configured to monitor the operating voltage output from the power supply unit; and a measurement unit configured to repeatedly measure a fixed time period when the operating voltage is normally supplied, wherein each time the measurement unit measures the fixed time period, the determination unit determines whether a connection error of the cable has occurred in accordance with the current detected by the detection unit, irrespective of a state of voltage generation in the voltage generation circuit.

11. The image forming apparatus according to claim 10, wherein the fixed time period is longer than a time period from when the control circuit issues an instruction for generating a predetermined voltage to when the voltage generated by the voltage generation circuit reaches the predetermined voltage, and is shorter than a time period of one rotation of the image carrier.

12. The image forming apparatus according to claim 1, wherein the load is a charging unit that uniformly charges a surface of the image carrier.

13. The image forming apparatus according to claim 1, wherein the load is a developing unit that develops, using toner, an electrostatic latent image formed on the image carrier.

14. The image forming apparatus according to claim 1, wherein the load is a transfer unit configured to transfer, to the recording medium, the toner image formed on the image carrier.

15. An image forming apparatus comprising:

an image carrier;

an image forming unit configured to form a toner image on the image carrier, and transfer the toner image to a recording medium;

a voltage generation circuit configured to generate a high voltage used for the image forming unit;

a control circuit that is connected to the voltage generation circuit via a cable, and configured to control the voltage generated by the voltage generation circuit;

a detection unit configured to detect a current flowing in a load of the image forming unit to which the high voltage generated by the voltage generation circuit is applied; and a determination unit configured to determine an error in accordance with a current range in which the current detected by the detection unit falls, the current range being included among a plurality of current ranges that are in one-to-one correspondence with a plurality of errors, wherein among the plurality of errors, a connection error of the cable is determined by the determination unit using the current that is detected by the detection unit during a supply of an operating voltage to the voltage generation circuit, and an error different from the connection error of the cable is determined by the determination unit using the current that is detected by the detection unit while the voltage output from the voltage generation circuit is maintained at a predetermined voltage.

* * * * *